US005172629A

United States Patent [19]

Merry

[11] Patent Number: 5,172,629

[45] Date of Patent: Dec. 22, 1992

[54] METHOD AND APPARATUS FOR COMPRESSION PACKAGING

[75] Inventor: Wayne M. Merry, Winston Salem, N.C.

[73] Assignee: NovaPak, Inc., Atlanta, Ga.

[21] Appl. No.: 737,328

[22] Filed: Jul. 29, 1991

Related U.S. Application Data

[63] Continuation-in-part of Ser. No. 451,051, Dec. 15, 1989, Pat. No. 5,042,227.

[51] Int. Cl.[5] ..... B30B 12/00

[52] U.S. Cl. ..... 100/35; 53/436

[58] Field of Search ..... 53/436, 438, 121, 529, 53/439, 442; 264/134, 321, 28, 324; 28/118, 119, 120; 223/37, 38, 52, 57; 2/69, 89, 94; 100/1, 2, 34, 35

[56] References Cited

U.S. PATENT DOCUMENTS 2,575,672 11/1951 Miller ..... 100/35
2,764,859 10/1956 Hanselmann ..... 53/22
4,408,438 10/1983 Rewitzer ..... 53/529
4,848,222 7/1989 Fleissner ..... 53/529
5,042,227 8/1991 Merry ..... 53/438

FOREIGN PATENT DOCUMENTS 2237430 2/1975 France .

*Primary Examiner*—Philip R. Coe
*Assistant Examiner*—Reginald L. Alexander
*Attorney, Agent, or Firm*—Needle & Rosenberg

[57] ABSTRACT

The present invention provides a method of compacting a sheet article, for example an article of underwear, to produce a stable, substantially rigid, compacted article. This reduces space required for storage and distribution and facilitates packaging of the article. Compaction is effected by placing the article, or a plurality of articles, in a mold cavity, and subjecting them to elevated pressure for a certain time. The pressure and time are selected to compact the article sufficiently for form the stable, rigid body, but simultaneously not being so great as to either damage the article or compact it so much that water or other liquid is required to recover the article from its compacted state to its original state.

18 Claims, 1 Drawing Sheet

METHOD AND APPARATUS FOR COMPRESSION PACKAGING

CROSS-REFERENCE TO RELATED APPLICATION

This is a continuation-in-part of our co-pending application Ser. No. 07/451,051 filed Dec. 15, 1989, now U.S. Pat. No. 5,042,227.

FIELD OF THE INVENTION

This invention relates to a method of compressing woven sheet articles and such woven articles when compressed. More particularly, it relates to methods of compressing such sheet articles into a compact form, which the article will retain after removal of the applied pressure but which will enable a user to return the sheet article to its original condition without the use of water or other liquid. This is based on a previous patent application which only applied to cotton based goods. Over the last two years it has been found and documented that a wider range of textiles also can be compacted in a similar manner.

BACKGROUND OF THE INVENTION

At the present time, there are a variety of known techniques for compressing fibrous articles, but no known techniques provide for compressing a woven sheet article such that it can be returned to its original condition without the use of some liquid agent.

U.S. Pat. Nos. 2,659,935 (Hammon); 2,952,462 (Planin); 3,306,966 (Matejcek); 3,189,669 (Goldfein); 3,342,922 (Karpovich et al.); 3,504,064 (Bauer); and 4,529,569 (Palau) generally relate to methods for compressing a sponge material to a compacted, stable condition. A variety of techniques are disclosed is these patents, depending upon the application of different agents, adhesives and temperatures and pressures. However, it is noteworthy that in all these proposals, some sort of liquid agent, usually water, is required to return the sponge article to its original expanded condition. Further, in all of these patents, except for the Planin U.S. Pat. No. 2,952,462, the article has approximately the same configuration in the compressed and expended conditions; the Planin Patent is concerned with the sponge articles, such as a toy duck, which is compressed into a different form e.g. a circular disc. Some of the patents, e.g. the Bauer U.S. Pat. No. 3,504,064, require even more extreme conditions to return the article to its original shape, e.g. the application of both heat and steam. It is also noteworthy that these patents are concerned with a sponge material, rather than woven sheet material.

There are also a number of patents relating to machines and methods of making tampons. U.S. patents showing such methods are U.S. Pat. Nos. 2,134,930 (Reynolds); 2,336,744 (Manning); 2,425,004 (Rabell); and 2,462,178 (Ganz). These patents disclose a variety of different techniques for compressing fibrous material to form tampons. There are some notable differences from the present invention. Thus, the material used is loose fibrous material, as exemplified by the Manning Patent in which fibrous material enters through an opening and is deposited on a screen where air pressure causes it to form the pads. Further, in the nature of the product, there is no necessity for the product to be able to resume any original, uncompressed state in the absence of moisture. Further, many of these patents disclose quite elaborate folding or forming techniques, e.g. the Rabell Patent, whereas as detailed below, the present invention does not require such careful folding or forming of the uncompressed article.

U.S. Pat. No. 4,096,230 is another example of a sponge material which is compressed and is capable of returning to an uncompressed condition. This again relies upon the use of moisture to return to its original shape. The article is a dehydrated prosthesis, for insertion end-wise into a body opening, e.g. the ear canal, where it absorbs moisture and turns to its original shape.

U.S. Pat. No. 4,757,669 (Areblom) sets forth the compressing and shrink wrapping of garments or other compressible garments to reduce their volume to between one-third and one-half of their original volume.

In the art of packaging woven sheet articles, a number of suppliers from the far East have developed techniques for compressing sheet articles under pressure to a compacted, solidified form, which is stable after the pressure has been released. However, this technique requires the article to be soaked in water, for its return to its original loose, uncompressed state. In general, the technique used is somewhat crude, with the applied pressure and other parameters not being significantly controlled, and indeed in many cases the operators are unaware of the exact conditions to which the articles are subjected. This technique is applied to such articles as face cloths, where clearly it is acceptable for them to be soaked in water to return the article to its original state in which it could be used. Since a face cloth is in any event wetted prior to use, this is no disadvantage.

U.S. Pat. No. 4,241,007 (Tanaka et al.) is an example of a technique for producing a compressed cloth-like article, which can be returned to its original state by absorption of water. Thus, it is intended for use on face cloths and the like. The patent suggests the use of very high pressures, in the range of 1,100 to 1,500 kilograms per square centimeter, preferably 1,200–1,300 kilograms per square centimeter. The larger range is equivalent to pressures in the range 15,640 to 21,330 p.s.i., which is a very high pressure. In the light of the results discovered by the present applicant, discussed below, these pressures are surprising. In very general terms, applicant has discovered that, for a variety of materials, pressures in excess of a few thousand p.s.i. resulted in damage to the article. This U.S. Patent (Tanaka et al.) does refer to a published Japanese utility model Application No. 36,565/1977 which utilizes a pressure as low as 30 kilograms per square centimeter, or approximately 425 p.s.i. Again, this apparently is for an article which can be recovered to its original state by absorbing water. It is also noted that this Tanaka patent discusses in the examples the use of a binderless cellulosic non-woven fabric, which is somewhat different from the materials used by the present applicant. It is further noted that binderless cellulosic non-woven fabric appears to be higher in compression elasticity, thereby requiring higher pressures to ensure a well compressed product which is not wrinkled at the edges. Indeed, the example uses a control at a pressure 1,000 kilograms per square centimeters to show that the compression and molding is inadequate at this pressure.

However, it will readily be appreciated that for many articles the technique of wetting a compressed article as purchased, in order to return it to an original uncompressed condition for use is entirely unacceptable. In effect, a user would have to wet the article to loosen and expand it, and then dry the article.

There are many articles for which it would be desirable to apply such a compression packaging technique. Articles such as socks, underwear, pantyhose are all relatively expensive to package. Indeed, for a product such as pantyhose, large amounts of money, time and effort are expended in developing satisfactory packaging techniques, which nonetheless require a significant amount of manual labor in the packaging of the product. Many of these articles are of relatively low cost, so that the packaging cost can be significant.

SUMMARY OF THE PRESENT INVENTION

In accordance with the present invention, there is provided a method of compressing a woven sheet article to produce a solid, stable compacted article, the method comprising: (a) placing the sheet article in a mold; (b) subjecting the sheet article to an elevated pressure in the mold for a certain time, which pressure and time are selected so that the sheet article is compressed to form a stable, substantially rigid body, which retains substantially the shape of the mold after removal therefrom and which can be returned to its original uncompressed condition by manipulation thereof and without addition of any liquid; and (c) removing the compressed article from the mold.

Thus, in contrast to the prior art, the present invention is intended to provide a compressed woven sheet article which can be returned to its original state without having to soak it in water or other liquid. This enables the technique to be applied to a variety of commonly available articles, such as socks, underwear and pantyhose.

When such articles are compressed by the method of the present invention, they assume a compact shape which makes subsequent packaging steps quite simple. For example, if a pair of socks is compressed into a solid, generally disc-shape, then they can be packaged simply by being shrink-wrapped in a plastic film, with appropriate markings included on it or on a separate identification sheet. Further, during the compression step, there is no need for the socks or other articles to be folded in any particular manner. They could simply be dropped loosely into a cavity in a mold, thereby eliminating the necessity for any careful folding, etc. Nonetheless, in the compressed state, they provide a neat and tidy appearance.

A further advantage of compressing many woven articles is that it greatly reduces the space required for storage and transportation. Thus, many woven articles are of a relatively low density and require a lot of space for transportation and storage. When compressed by the method of the present invention, the storage and transportation problems are reduced, thereby saving on costs. Further, when articles such as socks are in a compressed, relatively solid form, they are easier to handle during storage and transportation.

While the invention is primarily applicable to woven sheet articles, e.g. items of clothing, it is also envisaged that it could be applied to other articles, e.g. disposable or cloth baby diapers. In this case, an appropriately shaped mold would be provided, and the diapers would be compressed to reduce their bulk for packaging and storage. The end user would open up the diaper and by manipulation restore it to its expanded or uncompressed condition.

BRIEF DESCRIPTION OF THE DRAWINGS

For better understanding the present invention and to show more clearly how it may be carried into effect, reference will now be made, by way of example, to the accompanying drawings in which.

DESCRIPTION OF THE PREFERRED EMBODIMENT

Figure 1:
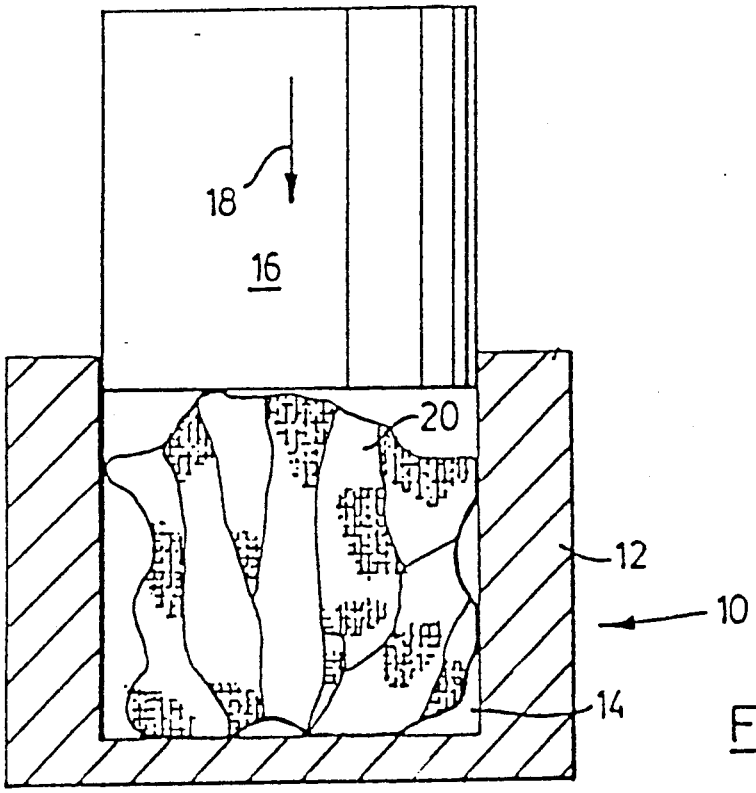
FIG. 1 is a cross-sectional view of a mold for carrying out the method of the present invention, including an article to be compressed.

Referring first to FIG. 1, there is shown a mold, generally indicated by the reference 10. The mold 10 has a lower mold part or body 12, which defines a generally cylindrical cavity 14. The cavity 14 is closed at this lower end. A plunger on piston 16 is also cylindrical and is dimensioned to form a close sliding fit in the cavity or bore 14.

As indicated by the arrow 18, the plunger 16 is mounted to be pressed downwardly into the cavity 14. However, it will be appreciated that, in known manner, it is immaterial which of the mold body 12 and plunger 16 move, and indeed both elements can be moved simultaneously towards one another.

A woven sheet article is indicated schematically at 20. The sheet article is simply dropped into the cavity 14, so that no part of it extends out of the cavity 14. In accordance with the present invention, it need not be necessary for the sheet article 20 to be folded in any way. The plunger 16 is then inserted into the top of the cavity 14, and a desire pressure applied to it. Once this pressure has been applied, it is held for a predetermined time.

In accordance with the present invention, and as discussed below in relation to specific examples, the pressure and time are selected so as to compact the article sufficiently to form a generally stable, solidified body, but simultaneously the compression is not so great as to prevent the article being returned to its original shape by an end user. In this respect, for some applications, it may be sufficient that the article is sufficiently compressed to be stable for only a relatively short time after removal from the mold 10. The article is then packaged in a close fitting package, which maintains the article in its compressed state. For other articles or applications, it can be preferred to compress the article sufficiently that it will retain a compressed, stable configuration for a long period of time. An important factor in determining an article's ability to retain a compressed condition is the tendency for the article to absorb moisture. This in turn both depends on the material of the article and how well it is protected from moisture. Thus, suitable packaging can assist in retaining the compressed state simply by preventing moisture from being absorbed.

To return the article to its original, uncompressed condition, where the article is in an individual package, the packaging is first removed. The user then simply pulls the article out of its compressed shape, by pulling on loose edges or corners of the article upon the exterior of the compressed article 22. With most articles, this can be done readily and simply. Certain articles, e.g.

those formed from delicate fabrics, a certain degree of care may be required. Nonetheless, it is a simple matter for a user to pull the article out of its compressed state and return it to its original uncompressed state.

As a result of the compacting of the article, it will then almost certainly have been extensively creased. However, for many articles this is immaterial, e.g. underwear, or alternatively the creases will quickly disappear. Thus, for articles such as socks and pantyhose, the presence of creases is immaterial, since they effectively disappear once they are worn. For other articles such as shop cloths, the presence of creases is immaterial to their function, or their appearance is immaterial.

Figure 2:
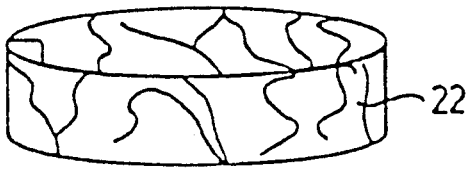
FIG. 2 is a perspective view of an article after compression in the mold of FIG. 1.
Figure 3:
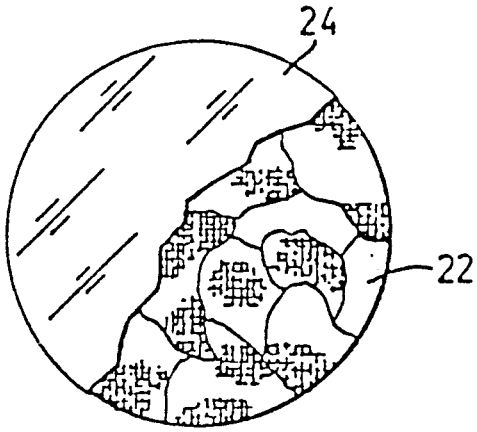
FIG. 3 is a plan view with portions cut away of the compressed article of FIG. 2, after enclosure in packaging.

FIG. 3 shows a plan view of the article 22 in the compressed or compacted condition of FIG. 2, when provided with packaging 24. The packaging 24 comprises a film or plastic material shrink-wrapped around the exterior of the article 22, both to provide an attractive exterior package and to assist it in retaining its shape. It also prevents the infusion of water, i.e. provides an hermetic package. This type of packaging 24 can be used when the compressed condition will not be maintained for a long period of time either because of an inherent quality in the article or because of the nature of the compression step.

Eight examples of the application of the present invention will now be discussed in relation to different types of woven sheet articles. The following specific examples are intended to illustrate more fully the nature of the invention without acting as a limitation upon its scope.

EXAMPLE 1

This first example was carried out on fabric by piece sold under the brand name SUPPLEX (DuPont). The fabric was 24 to 48 inches. The material of the fabric comprised 100% nylon. One fabric piece was placed in each cavity 14 for this example. The following Table 1 gives the results obtained.

TABLE 1

| | SECONDS | | | | | | | | | | | |
|---|---|---|---|---|---|---|---|---|---|---|---|---|
| PSI | .10 | .5 | 1 | 1.5 | 2 | 2.5 | 3 | 3.5 | 4 | 4.5 | 5 | 5.5 |
| 1-100 | CU | CU | CU | CU | CU | CU | CU | CU | CU | CU | CU | CU |
| 200 | CU | CU | CU | CU | CU | CU | CU | CU | CU | CU | CU | CU |
| 300 | CU | CU | CU | CU | CU | CU | CU | CU | CU | CU | CU | CU |
| 400 | CU | CU | CU | CU | CU | CU | CU | CU | CU | CU | CU | CU |
| 500 | CU | CU | CU | CU | CU | CU | CU | CU | CU | CU | CU | CU |
| 600 | CU | CU | CU | CU | CU | CU | CU | CU | CU | CU | CU | CU |
| 700 | CU | CU | CU | CU | CU | CU | CU | CU | CU | CU | CU | CU |
| 800 | CU | CU | CU | CU | CU | CU | CU | CU | CU | CU | CU | CU |
| 900 | CU | CU | CU | CU | CU | CU | CU | CU | CU | CU | CU | CU |
| 1000 | CU | CU | NWR | NWR | NWR | NWR | NWR | NWR | NWR | NWR | NWR | NWR |
| 1100 | NWR | NWR | NWR | NWR | NWR | NWR | NWR | NWR | NWR | NWR | NWR | NWR |
| 1200 | NWR | NWR | NWR | NWR | NWR | NWR | NWR | NWR | NWR | NWR | NWR | NWR |
| 1300 | NWR | NWR | NWR | NWR | NWR | NWR | NWR | NWR | NWR | NWR | NWR | NWR |
| 1400 | NWR | NWR | NWR | NWR | NWR | NWR | NWR | NWR | NWR | NWR | NWR | NWR |
| 1500 | NWR | NWR | NWR | NWR | NWR | NWR | NWR | NWR | NWR | NWR | NWR | NWR |
| 1600 | NWR | NWR | NWR | NWR | NWR | NWR | NWR | NWR | NWR | NWR | NWR | NWR |
| 1700 | NWR | NWR | NWR | NWR | NWR | NWR | NWR | NWR | NWR | NWR | NWR | NWR |
| 1800 | NWR | NWR | NWR | NWR | NWR | NWR | NWR | NWR | NWR | NWR | NWR | NWR |
| 1900 | NWR | NWR | WR | WR | WR | WR | WR | WR | WR | WR | WR | WR |
| 2000 | WR | WR | WR | WR | WR | WR | WR | WR | WR | WR | WR | WR |
| 2100 | WR | WR | WR | WR | WR | WR | WR | WR | WR | WR | WR | WR |
| 2200 | WR | WR | WR | WR | WR | WR | WR | WR | WR | WR | WR | WR |
| 2300 | WR | WR | WR | WR | DO | DO | DO | DO | DO | DO | DO | DO |
| 2400 | DO. | DO | DO | DO | DO | DO | DO | DO | DO | DO | DO | DO |
| 2500 | DO | DO | DO | DO | DO | DO | DO | DO | DO | DO | DO | DO |
| 2600 | DO | DO | DO | DO | DO | DO | DO | DO | DO | DO | DO | DO |
| 2700 | DO | DO | DO | DO | DO | DO | DO | DO | DO | DO | DO | DO |
| 2800 | DO | DO | DO | DO | DO | DO | DO | DO | DO | DO | DO | DO |
| 2900 | DO | DO | DO | DO | DO | DO | DO | DO | DO | DO | DO | DO |
| 3000 | DO | DO | DO | DO | DO | DO | DO | DO | DO | DO | DO | DO |

In this Table 1, and also the data in the following tables and eight examples, the following abbreviations apply:

CU = compaction unsuccessful

NWR = No water required for recovery of original shape

WR = Water required for recovery of original shape

DO = Damage occurred

As for all of the tests, the time employed varied from one-tenth of a second through to five and one-half seconds, at one-half second increments. The pressure in this example was varied from 100 to 3,000 p.s.i. As can be seen, there is a broad range of values, denoted by NWR, where satisfactory compaction was achieved, without requiring water to enable an end user to recover the socks to their original uncompacted condition. This condition is alternatively defined as "air recovery".

In this example, at pressures of 900 p.s.i. or less, the compaction was always unsuccessful, irrespective of the time. Similarly, for pressures of 2,400 p.s.i. or greater, damage occurred in all samples, irrespective of the duration of the time.

For pressures in the range of 1,000 to 2,300 p.s.i., successful compaction occurred. However, for the 1,000 p.s.i. and 2,300 p.s.i. values, compaction was only successful for certain time ranges. Thus, as might be expected, for the lower pressure, a greater time was required, and time of at least one second is required to get successful compaction at this pressure. At pressure ranges from 1,900 to 2,300 p.s.i., Water was required for recovery. Certainly, for the high pressure, long duration of compaction results in damage. Thus, at 2,300 p.s.i., the pressure can only be applied for one and one-half seconds at the most, to avoid damage. In the narrower pressure range from 1,100 to 2,200, successful compaction occurred at all times in the chart.

EXAMPLE 2

This second example was carried out using fabric by piece. The fabric piece was 24 by 48 inches, and had a composition of 100% rayon. One unit of the fabric was randomly inserted into the cavity 14 for each compaction. The following results were obtained:

TABLE 2

| | SECONDS | | | | | | | | | | | |
|---|---|---|---|---|---|---|---|---|---|---|---|---|
| PSI | .10 | .5 | 1 | 1.5 | 2 | 2.5 | 3 | 3.5 | 4 | 4.5 | 5 | 5.5 |
| 1-100 | CU | CU | CU | CU | CU | CU | CU | CU | CU | CU | CU | CU |
| 200 | CU | CU | CU | CU | CU | CU | CU | CU | CU | CU | CU | CU |
| 300 | CU | CU | CU | CU | CU | CU | CU | CU | CU | CU | CU | CU |
| 400 | CU | NWR | NWR | NWR | NWR | NWR | NWR | NWR | NWR | NWR | NWR | NWR |
| 500 | NWR | NWR | NWR | NWR | WR | WR | WR | WR | WR | WR | WR | WR |
| 600 | WR | WR | WR | WR | WR | WR | WR | WR | WR | WR | WR | WR |
| 700 | WR | WR | WR | WR | WR | WR | WR | WR | WR | WR | WR | WR |
| 800 | WR | WR | WR | WR | WR | WR | WR | WR | WR | WR | WR | WR |
| 900 | WR | WR | WR | WR | WR | WR | WR | WR | WR | WR | WR | WR |
| 1000 | WR | WR | WR | WR | WR | WR | WR | WR | WR | WR | WR | WR |
| 1100 | WR | WR | WR | WR | WR | WR | WR | WR | WR | WR | WR | WR |
| 1200 | WR | WR | WR | WR | WR | WR | WR | WR | WR | WR | WR | WR |
| 1300 | WR | WR | WR | WR | WR | WR | WR | WR | WR | WR | WR | WR |
| 1400 | WR | WR | WR | WR | WR | WR | WR | WR | WR | WR | WR | WR |
| 1500 | WR | WR | WR | WR | WR | WR | WR | WR | WR | WR | WR | WR |
| 1600 | WR | WR | WR | WR | WR | WR | WR | WR | WR | WR | WR | WR |
| 1700 | WR | WR | WR | WR | WR | WR | WR | WR | WR | WR | WR | WR |
| 1800 | WR | WR | WR | WR | WR | WR | WR | WR | WR | WR | WR | WR |
| 1900 | WR | WR | WR | WR | WR | WR | WR | WR | WR | WR | WR | WR |
| 2000 | WR | WR | WR | WR | WR | WR | WR | WR | WR | WR | WR | WR |
| 2100 | WR | WR | WR | WR | WR | WR | WR | WR | WR | WR | WR | WR |
| 2200 | WR | WR | WR | WR | WR | WR | WR | WR | WR | WR | WR | WR |
| 2300 | DO | DO | DO | DO | DO | DO | DO | DO | DO | DO | DO | DO |
| 2400 | DO | DO | DO | DO | DO | DO | DO | DO | DO | DO | DO | DO |
| 2500 | DO | DO | DO | DO | DO | DO | DO | DO | DO | DO | DO | DO |
| 2600 | DO | DO | DO | DO | DO | DO | DO | DO | DO | DO | DO | DO |
| 2700 | DO | DO | DO | DO | DO | DO | DO | DO | DO | DO | DO | DO |
| 2800 | DO | DO | DO | DO | DO | DO | DO | DO | DO | DO | DO | DO |
| 2900 | DO | DO | DO | DO | DO | DO | DO | DO | DO | DO | DO | DO |
| 3000 | DO | DO | DO | DO | DO | DO | DO | DO | DO | DO | DO | DO |

As the results show, a wide range of pressure values were obtained in which the fabric could be recovered to its uncompacted form, although approximately four-fifths of these required water to recover the fabric.

For this example, acceptable pressures ranged from 400 to 2,200 p.s.i. At the lower pressure of 400 p.s.i., the minimum time to obtain satisfactory compaction was one-half second, while at the upper limit of 2,200 p.s.i., the maximum acceptable compaction time was at least five and one-half seconds. At the lower pressure below one-half second, compaction was unsuccessful, while damage occurred at any time at a pressure higher than 2,200 p.s.i.

Also, it was generally found that at acceptable pressures equal to or greater than 600 p.s.i., water was required at all times to recover the shape of the fabric, although it should be noted that at the time of two seconds in Table 2, water was necessary for recovery at a pressure of 500 p.s.i. Again, in general the longer the stay time for the pressure, the greater the chance that damage would occur.

EXAMPLE 3

This example was carried out using fabric by piece comprising a blend of 50% polyester and 50% rayon. The fabric piece was 24 by 48 inches. Again, one unit of cloth was compacted per stroke in cavity 14. The results are tabulated in Table 3.

TABLE 3

| | SECONDS | | | | | | | | | | | |
|---|---|---|---|---|---|---|---|---|---|---|---|---|
| PSI | .10 | .5 | 1 | 1.5 | 2 | 2.5 | 3 | 3.5 | 4 | 4.5 | 5 | 5.5 |
| 1-100 | CU | CU | CU | CU | CU | CU | CU | CU | CU | CU | CU | CU |
| 200 | CU | CU | CU | CU | CU | CU | CU | CU | CU | CU | CU | CU |
| 300 | CU | CU | CU | CU | CU | CU | NWR | NWR | NWR | NWR | NWR | NWR |
| 400 | NWR | NWR | NWR | NWR | NWR | NWR | NWR | NWR | NWR | NWR | NWR | NWR |
| 500 | NWR | NWR | NWR | NWR | NWR | NWR | NWR | NWR | NWR | NWR | NWR | NWR |
| 600 | NWR | NWR | NWR | NWR | NWR | NWR | NWR | NWR | NWR | NWR | NWR | NWR |
| 700 | NWR | NWR | NWR | NWR | NWR | NWR | NWR | NWR | NWR | NWR | NWR | NWR |
| 800 | NWR | NWR | NWR | NWR | NWR | NWR | NWR | NWR | NWR | NWR | NWR | NWR |
| 900 | NWR | NWR | NWR | NWR | NWR | NWR | NWR | NWR | NWR | NWR | NWR | NWR |
| 1000 | NWR | NWR | NWR | NWR | NWR | NWR | WR | WR | WR | WR | WR | WR |
| 1100 | WR | WR | WR | WR | WR | WR | WR | WR | WR | WR | WR | WR |
| 1200 | WR | WR | WR | WR | WR | WR | WR | WR | WR | WR | WR | WR |
| 1300 | WR | WR | WR | WR | WR | WR | WR | WR | WR | WR | WR | WR |
| 1400 | WR | WR | WR | WR | WR | WR | WR | WR | WR | WR | WR | WR |
| 1500 | WR | WR | WR | WR | WR | WR | WR | WR | WR | WR | WR | DO |
| 1600 | DO | DO | DO | DO | DO | DO | DO | DO | DO | DO | DO | DO |
| 1700 | DO | DO | DO | DO | DO | DO | DO | DO | DO | DO | DO | DO |
| 1800 | DO | DO | DO | DO | DO | DO | DO | DO | DO | DO | DO | DO |
| 1900 | DO | DO | DO | DO | DO | DO | DO | DO | DO | DO | DO | DO |
| 2000 | DO | DO | DO | DO | DO | DO | DO | DO | DO | DO | DO | DO |

TABLE 3-continued

| | SECONDS | | | | | | | | | | | |
|---|---|---|---|---|---|---|---|---|---|---|---|---|
| PSI | .10 | .5 | 1 | 1.5 | 2 | 2.5 | 3 | 3.5 | 4 | 4.5 | 5 | 5.5 |
| 2100 | DO | DO | DO | DO | DO | DO | DO | DO | DO | DO | DO | DO |
| 2200 | DO | DO | DO | DO | DO | DO | DO | DO | DO | DO | DO | DO |
| 2300 | DO | DO | DO | DO | DO | DO | DO | DO | DO | DO | DO | DO |
| 2400 | DO | DO | DO | DO | DO | DO | DO | DO | DO | DO | DO | DO |
| 2500 | DO | DO | DO | DO | DO | DO | DO | DO | DO | DO | DO | DO |
| 2600 | DO | DO | DO | DO | DO | DO | DO | DO | DO | DO | DO | DO |
| 2700 | DO | DO | DO | DO | DO | DO | DO | DO | DO | DO | DO | DO |
| 2800 | DO | DO | DO | DO | DO | DO | DO | DO | DO | DO | DO | DO |
| 2900 | DO | DO | DO | DO | DO | DO | DO | DO | DO | DO | DO | DO |
| 3000 | DO | DO | DO | DO | DO | DO | DO | DO | DO | DO | DO | DO |

The broad range of acceptable pressures is from 300 to 1,500 p.s.i. At the lower range of 300, it was found that the lowest time to give successful compaction was three seconds. Correspondingly, at the upper pressure of 1,500 p.s.i., the maximum time to give acceptable compaction, without damage occurring, was five seconds. At pressure ranges of 1,000 p.s.i. to 1,500 p.s.i. water was required for recovery.

EXAMPLE 4

This fourth example was carried out on fabric by piece. The fabric piece was 24 by 48 inches. The composition of the material was 100% polyester. One fabric piece per cavity 14 was used in this example. The results are tabulated in the following Table 4.

As the table shows, a broad range of acceptable pressures was obtained, from 300 p.s.i. to 1,800 p.s.i. At the lower limit of 300 p.s.i., the minimum stay time for successful compaction is four and one-half seconds, while at the upper limit of 1,800 p.s.i., the maximum stay time to avoid damage occurring is one-half second. At successful compaction pressures in the range of 1,700 p.s.i. to 1,800 p.s.i., water was required for recovery.

EXAMPLE 5

This fifth example was carried out on anti-static wipes. The wipes were 3 by 7 inches. The material of the wipes comprised 100% polyester. The following Table 5 gives the results obtained.

TABLE 4

| | SECONDS | | | | | | | | | | | |
|---|---|---|---|---|---|---|---|---|---|---|---|---|
| PSI | .10 | .5 | 1 | 1.5 | 2 | 2.5 | 3 | 3.5 | 4 | 4.5 | 5 | 5.5 |
| 1-100 | CU | CU | CU | CU | CU | CU | CU | CU | CU | CU | CU | CU |
| 200 | CU | CU | CU | CU | CU | CU | CU | CU | CU | CU | CU | CU |
| 300 | CU | CU | CU | CU | CU | CU | CU | CU | CU | NWR | NWR | NWR |
| 400 | NWR | NWR | NWR | NWR | NWR | NWR | NWR | NWR | NWR | NWR | NWR | NWR |
| 500 | NWR | NWR | NWR | NWR | NWR | NWR | NWR | NWR | NWR | NWR | NWR | NWR |
| 600 | NWR | NWR | NWR | NWR | NWR | NWR | NWR | NWR | NWR | NWR | NWR | NWR |
| 700 | NWR | NWR | NWR | NWR | NWR | NWR | NWR | NWR | NWR | NWR | NWR | NWR |
| 800 | NWR | NWR | NWR | NWR | NWR | NWR | NWR | NWR | NWR | NWR | NWR | NWR |
| 900 | NWR | NWR | NWR | NWR | NWR | NWR | NWR | NWR | NWR | NWR | NWR | NWR |
| 1000 | NWR | NWR | NWR | NWR | NWR | NWR | NWR | NWR | NWR | NWR | NWR | NWR |
| 1100 | NWR | NWR | NWR | NWR | NWR | NWR | NWR | NWR | NWR | NWR | NWR | NWR |
| 1200 | NWR | NWR | NWR | NWR | NWR | NWR | NWR | NWR | NWR | NWR | NWR | NWR |
| 1300 | NWR | NWR | NWR | NWR | NWR | NWR | NWR | NWR | NWR | NWR | NWR | NWR |
| 1400 | NWR | NWR | NWR | NWR | NWR | NWR | NWR | NWR | NWR | NWR | NWR | NWR |
| 1500 | NWR | NWR | NWR | NWR | NWR | NWR | NWR | NWR | NWR | NWR | NWR | NWR |
| 1600 | NWR | NWR | NWR | NWR | NWR | NWR | NWR | NWR | NWR | NWR | NWR | NWR |
| 1700 | NWR | NWR | WR | WR | WR | WR | WR | WR | WR | WR | WR | WR |
| 1800 | WR | WR | DO | DO | DO | DO | DO | DO | DO | DO | DO | DO |
| 1900 | DO | DO | DO | DO | DO | DO | DO | DO | DO | DO | DO | DO |
| 2000 | DO | DO | DO | DO | DO | DO | DO | DO | DO | DO | DO | DO |
| 2100 | DO | DO | DO | DO | DO | DO | DO | DO | DO | DO | DO | DO |
| 2200 | DO | DO | DO | DO | DO | DO | DO | DO | DO | DO | DO | DO |
| 2300 | DO | DO | DO | DO | DO | DO | DO | DO | DO | DO | DO | DO |
| 2400 | DO | DO | DO | DO | DO | DO | DO | DO | DO | DO | DO | DO |
| 2500 | DO | DO | DO | DO | DO | DO | DO | DO | DO | DO | DO | DO |
| 2600 | DO | DO | DO | DO | DO | DO | DO | DO | DO | DO | DO | DO |
| 2700 | DO | DO | DO | DO | DO | DO | DO | DO | DO | DO | DO | DO |
| 2800 | DO | DO | DO | DO | DO | DO | DO | DO | DO | DO | DO | DO |
| 2900 | DO | DO | DO | DO | DO | DO | DO | DO | DO | DO | DO | DO |
| 3000 | DO | DO | DO | DO | DO | DO | DO | DO | DO | DO | DO | DO |

TABLE 5

| | SECONDS | | | | | | | | | | | |
|---|---|---|---|---|---|---|---|---|---|---|---|---|
| PSI | .10 | .5 | 1 | 1.5 | 2 | 2.5 | 3 | 3.5 | 4 | 4.5 | 5 | 5.5 |
| 1-100 | CU | CU | CU | CU | CU | CU | CU | CU | CU | CU | CU | CU |
| 200 | CU | CU | CU | CU | CU | CU | CU | CU | CU | CU | CU | CU |
| 300 | CU | CU | CU | CU | CU | CU | CU | CU | CU | NWR | NWR | NWR |
| 400 | NWR | NWR | NWR | NWR | NWR | NWR | NWR | NWR | NWR | NWR | NWR | NWR |
| 500 | NWR | NWR | NWR | NWR | NWR | NWR | NWR | NWR | NWR | NWR | NWR | NWR |
| 600 | NWR | NWR | NWR | NWR | NWR | NWR | NWR | NWR | NWR | NWR | NWR | NWR |
| 700 | NWR | NWR | NWR | NWR | NWR | NWR | NWR | NWR | NWR | NWR | NWR | NWR |

TABLE 5-continued

| | SECONDS | | | | | | | | | | | |
|---|---|---|---|---|---|---|---|---|---|---|---|---|
| PSI | .10 | .5 | 1 | 1.5 | 2 | 2.5 | 3 | 3.5 | 4 | 4.5 | 5 | 5.5 |
| 800 | NWR | NWR | NWR | NWR | NWR | NWR | NWR | NWR | NWR | NWR | NWR | NWR |
| 900 | NWR | NWR | NWR | NWR | NWR | NWR | NWR | NWR | NWR | NWR | NWR | NWR |
| 1000 | NWR | NWR | NWR | NWR | NWR | NWR | NWR | NWR | NWR | NWR | NWR | NWR |
| 1100 | NWR | NWR | NWR | NWR | NWR | NWR | NWR | NWR | NWR | NWR | NWR | NWR |
| 1200 | NWR | NWR | NWR | NWR | NWR | NWR | NWR | NWR | NWR | NWR | NWR | NWR |
| 1300 | NWR | NWR | NWR | NWR | NWR | NWR | NWR | NWR | NWR | NWR | NWR | NWR |
| 1400 | NWR | NWR | NWR | NWR | NWR | NWR | NWR | NWR | NWR | NWR | NWR | NWR |
| 1500 | NWR | NWR | NWR | NWR | NWR | NWR | NWR | NWR | NWR | NWR | NWR | NWR |
| 1600 | NWR | NWR | NWR | NWR | NWR | NWR | NWR | NWR | NWR | NWR | NWR | NWR |
| 1700 | NWR | NWR | NWR | NWR | NWR | NWR | NWR | NWR | NWR | NWR | NWR | NWR |
| 1800 | NWR | NWR | NWR | NWR | NWR | NWR | NWR | NWR | NWR | NWR | NWR | NWR |
| 1900 | NWR | NWR | NWR | NWR | NWR | NWR | NWR | NWR | NWR | NWR | NWR | NWR |
| 2000 | NWR | NWR | NWR | NWR | NWR | NWR | NWR | NWR | NWR | NWR | NWR | NWR |
| 2100 | NWR | NWR | NWR | NWR | NWR | NWR | NWR | NWR | NWR | NWR | NWR | NWR |
| 2200 | NWR | NWR | NWR | NWR | NWR | NWR | NWR | NWR | NWR | NWR | NWR | NWR |
| 2300 | NWR | NWR | NWR | NWR | NWR | NWR | NWR | NWR | NWR | NWR | NWR | NWR |
| 2400 | NWR | NWR | NWR | NWR | NWR | NWR | NWR | NWR | NWR | NWR | NWR | NWR |
| 2500 | NWR | NWR | NWR | NWR | NWR | NWR | NWR | NWR | NWR | NWR | NWR | NWR |
| 2600 | NWR | NWR | WR | WR | WR | WR | WR | WR | WR | WR | WR | WR |
| 2700 | WR | WR | WR | WR | WR | WR | WR | WR | WR | WR | WR | WR |
| 2800 | WR | WR | WR | WR | WR | WR | WR | WR | WR | DO | DO | DO |
| 2900 | DO | DO | DO | DO | DO | DO | DO | DO | DO | DO | DO | DO |
| 3000 | DO | DO | DO | DO | DO | DO | DO | DO | DO | DO | DO | DO |

As can be seen, there is a broad range of values whether satisfactory compaction was achieved, without requiring water to enable an end user to recover the socks to their original uncompacted condition. Particularly, at all times in the pressure range of 400 p.s.i. to 2,500 p.s.i., successful compaction was obtained with no water required. At acceptable compaction pressure ranges from 2,600 to 2,800 p.s.i., water was required for recovery.

At pressures of 200 p.s.i., or less, the compaction was always unsuccessful, irrespective of the time. Similarly, for pressures of 2,900 p.s.i. or greater, damage occurred in all samples, irrespective of the duration of the time. For pressures in the range of 300 to 2,800 p.s.i., successful compaction occurred. However, for the 300 p.s.i. and 2,800 p.s.i. values, compaction was only successful for certain time ranges. A time of at least four and one half seconds is required to get successful compaction at a pressure of 300 p.s.i. For the high pressure at 2,800 p.s.i., the pressure can only be applied for four seconds at the most, to avoid damage.

EXAMPLE 6

This example was carried out on outdoor socks sold under the brand name FIELD & STREAM (Adams-Millis). The material of the socks comprised a blend of 50% polyester, 30% wool and 20% polypropylene. In this example one sock was placed in each mold. The following Table 6 gives the results obtained.

TABLE 6

| | SECONDS | | | | | | | | | | | |
|---|---|---|---|---|---|---|---|---|---|---|---|---|
| PSI | .10 | .5 | 1 | 1.5 | 2 | 2.5 | 3 | 3.5 | 4 | 4.5 | 5 | 5.5 |
| 1-100 | CU | CU | CU | CU | CU | CU | CU | CU | CU | CU | CU | CU |
| 200 | CU | CU | CU | CU | CU | CU | CU | CU | CU | CU | CU | CU |
| 300 | CU | CU | CU | CU | CU | CU | CU | CU | CU | CU | CU | CU |
| 400 | CU | CU | CU | CU | CU | CU | CU | CU | CU | CU | CU | CU |
| 500 | NWR | NWR | NWR | NWR | NWR | NWR | NWR | NWR | NWR | NWR | NWR | NWR |
| 600 | NWR | NWR | NWR | NWR | NWR | NWR | NWR | NWR | NWR | NWR | NWR | NWR |
| 700 | NWR | NWR | NWR | NWR | NWR | NWR | NWR | NWR | NWR | NWR | NWR | NWR |
| 800 | NWR | NWR | NWR | NWR | NWR | NWR | NWR | NWR | NWR | NWR | NWR | NWR |
| 900 | NWR | NWR | NWR | NWR | NWR | NWR | NWR | NWR | NWR | NWR | NWR | NWR |
| 1000 | NWR | NWR | NWR | NWR | NWR | NWR | NWR | NWR | NWR | NWR | NWR | NWR |
| 1100 | NWR | NWR | NWR | NWR | NWR | NWR | NWR | NWR | NWR | NWR | NWR | NWR |
| 1200 | NWR | NWR | NWR | NWR | NWR | NWR | NWR | NWR | NWR | NWR | NWR | NWR |
| 1300 | NWR | NWR | NWR | NWR | NWR | NWR | NWR | NWR | NWR | NWR | NWR | NWR |
| 1400 | NWR | NWR | NWR | NWR | NWR | NWR | NWR | NWR | NWR | NWR | NWR | NWR |
| 1500 | NWR | NWR | NWR | NWR | NWR | NWR | NWR | NWR | NWR | NWR | NWR | NWR |
| 1600 | NWR | NWR | NWR | NWR | NWR | NWR | NWR | NWR | NWR | NWR | NWR | NWR |
| 1700 | NWR | NWR | NWR | NWR | NWR | NWR | NWR | NWR | NWR | NWR | NWR | NWR |
| 1800 | NWR | NWR | NWR | NWR | NWR | NWR | NWR | NWR | NWR | NWR | NWR | NWR |
| 1900 | NWR | NWR | NWR | NWR | NWR | NWR | NWR | NWR | NWR | NWR | NWR | NWR |
| 2000 | NWR | NWR | NWR | NWR | NWR | NWR | NWR | NWR | NWR | NWR | NWR | NWR |
| 2100 | NWR | NWR | NWR | NWR | NWR | NWR | NWR | NWR | NWR | NWR | NWR | NWR |
| 2200 | NWR | NWR | NWR | NWR | NWR | NWR | NWR | NWR | NWR | NWR | NWR | NWR |
| 2300 | NWR | NWR | NWR | NWR | NWR | NWR | NWR | NWR | NWR | NWR | NWR | NWR |
| 2400 | NWR | NWR | NWR | NWR | NWR | NWR | WR | WR | WR | WR | WR | WR |
| 2500 | NWR | WR | WR | WR | WR | WR | WR | WR | WR | WR | WR | WR |
| 2600 | WR | WR | WR | WR | WR | WR | WR | WR | DO | DO | DO | DO |
| 2700 | DO | DO | DO | DO | DO | DO | DO | DO | DO | DO | DO | DO |
| 2800 | DO | DO | DO | DO | DO | DO | DO | DO | DO | DO | DO | DO |
| 2900 | DO | DO | DO | DO | DO | DO | DO | DO | DO | DO | DO | DO |
| 3000 | DO | DO | DO | DO | DO | DO | DO | DO | DO | DO | DO | DO |

As can be seen, there is a broad range of values, denoted by NWR, where satisfactory compaction was achieved, without requiring water to enable an end user to recover the socks to their original uncompacted condition. For pressures in the range 500 to 2,500 p.s.i., successful compaction occurred at all times. However, for the 2,600 p.s.i. value, compaction was only successful for certain time ranges. At pressure ranges from 2,400 to 2,600 p.s.i., water was required for recovery at certain compression times. At 2,600 p.s.i., the pressure can only be applied for three and one-half seconds at the most, to avoid damage. In the narrower pressure range from 500 to 2,300 p.s.i., successful compaction occurred at all times in the chart with no water required for recovery.

EXAMPLE 7

This example was carried out on socks sold under the brand name WEEKENDERS (Style #714) (Silver Knit Industries). The material of the socks comprised 25% nylon and 75% orlon acrylic and the socks were 18 inches. In this example, one pair of socks was placed in cavity 14. The following Table 7 gives the results obtained.

TABLE 7

| | SECONDS | | | | | | | | | | | |
|---|---|---|---|---|---|---|---|---|---|---|---|---|
| PSI | .10 | .5 | 1 | 1.5 | 2 | 2.5 | 3 | 3.5 | 4 | 4.5 | 5 | 5.5 |
| 1-100 | CU | CU | CU | CU | CU | CU | CU | CU | CU | CU | CU | CU |
| 200 | CU | CU | CU | CU | CU | CU | CU | CU | CU | CU | CU | CU |
| 300 | CU | CU | CU | CU | CU | CU | CU | CU | CU | CU | CU | CU |
| 400 | CU | CU | CU | CU | CU | CU | CU | CU | CU | CU | CU | CU |
| 500 | CU | CU | CU | CU | CU | CU | CU | CU | CU | CU | CU | CU |
| 600 | CU | CU | CU | CU | CU | CU | CU | CU | CU | CU | CU | CU |
| 700 | CU | CU | CU | CU | CU | CU | CU | CU | CU | CU | CU | CU |
| 800 | CU | CU | CU | CU | CU | CU | CU | CU | CU | CU | CU | CU |
| 900 | CU | CU | CU | CU | CU | CU | CU | CU | CU | CU | CU | CU |
| 1000 | CU | CU | CU | CU | CU | CU | CU | CU | CU | CU | CU | CU |
| 1100 | CU | CU | CU | CU | CU | CU | CU | CU | CU | CU | CU | CU |
| 1200 | CU | CU | CU | CU | CU | CU | CU | CU | CU | CU | CU | CU |
| 1300 | CU | CU | CU | CU | CU | CU | CU | CU | CU | CU | CU | CU |
| 1400 | CU | CU | CU | CU | CU | CU | CU | CU | CU | CU | CU | CU |
| 1500 | CU | CU | CU | CU | CU | CU | CU | CU | CU | CU | CU | CU |
| 1600 | CU | CU | CU | CU | CU | CU | CU | CU | CU | CU | CU | CU |
| 1700 | CU | CU | CU | CU | CU | CU | CU | CU | CU | CU | CU | CU |
| 1800 | CU | CU | CU | CU | CU | CU | CU | CU | CU | CU | CU | CU |
| 1900 | CU | CU | CU | CU | CU | CU | CU | CU | CU | NWR | NWR | NWR |
| 2000 | NWR | NWR | NWR | NWR | NWR | NWR | NWR | NWR | NWR | NWR | NWR | NWR |
| 2100 | NWR | NWR | NWR | NWR | NWR | NWR | NWR | NWR | NWR | NWR | NWR | NWR |
| 2200 | NWR | NWR | NWR | NWR | NWR | NWR | NWR | NWR | NWR | NWR | NWR | NWR |
| 2300 | NWR | NWR | NWR | NWR | NWR | NWR | NWR | NWR | NWR | NWR | NWR | NWR |
| 2400 | NWR | NWR | NWR | NWR | NWR | NWR | NWR | NWR | NWR | NWR | NWR | NWR |
| 2500 | NWR | NWR | NWR | NWR | NWR | NWR | WR | WR | WR | WR | WR | WR |
| 2600 | WR | WR | DO | DO | DO | DO | DO | DO | DO | DO | DO | DO |
| 2700 | DO | DO | DO | DO | DO | DO | DO | DO | DO | DO | DO | DO |
| 2800 | DO | DO | DO | DO | DO | DO | DO | DO | DO | DO | DO | DO |
| 2900 | DO | DO | DO | DO | DO | DO | DO | DO | DO | DO | DO | DO |
| 3000 | DO | DO | DO | DO | DO | DO | DO | DO | DO | DO | DO | DO |

As can be seen, for pressures in the range 1,900 to 2,600 p.s.i., successful compaction occurred. However, for the 1,900 p.s.i. and 2,600 p.s.i. values, compaction was only successful for certain time ranges. Thus, for the lower pressure, 1900 p.s.i., a time of at least four and one-half seconds was required to get successful compaction. At pressure ranges from 2,500 to 2,600 p.s.i., water was required for recovery. Certainly, for the high pressure, long duration of compaction results in damage. Thus, at 2,600 p.s.i., the pressure can only be applied for one-half second at the most, to avoid damage. In the narrower pressure range from 2,000 to 2,500 p.s.i., successful compaction occurred at all times in the chart.

This example was carried out on socks sold under the brand name WORLD'S SOFTEST SOCK from SOCKS GALORE (Adams-Millis). The material of the socks comprised 85% bulk acrylic and 15% nylon. One pair of socks was placed in cavity 14 in this example. The following Table 8 gives the results obtained.

TABLE 8

| | SECONDS | | | | | | | | | | | |
|---|---|---|---|---|---|---|---|---|---|---|---|---|
| PSI | .10 | .5 | 1 | 1.5 | 2 | 2.5 | 3 | 3.5 | 4 | 4.5 | 5 | 5.5 |
| 1-100 | CU | CU | CU | CU | CU | CU | CU | CU | CU | CU | CU | CU |
| 200 | CU | CU | CU | CU | CU | CU | CU | CU | CU | CU | CU | CU |
| 300 | CU | CU | CU | CU | CU | CU | CU | CU | CU | CU | CU | CU |
| 400 | CU | CU | CU | CU | CU | CU | CU | CU | CU | CU | CU | CU |
| 500 | CU | CU | CU | CU | CU | CU | CU | CU | CU | CU | CU | CU |
| 600 | CU | CU | CU | CU | CU | CU | CU | CU | CU | CU | CU | CU |
| 700 | CU | CU | CU | CU | CU | CU | CU | CU | CU | CU | CU | CU |
| 800 | CU | CU | CU | CU | CU | CU | CU | CU | CU | CU | CU | CU |
| 900 | CU | CU | CU | CU | CU | CU | CU | CU | CU | CU | CU | CU |
| 1000 | CU | CU | CU | CU | CU | CU | CU | CU | CU | CU | CU | CU |
| 1100 | CU | CU | CU | CU | CU | CU | CU | CU | CU | CU | CU | CU |
| 1200 | CU | CU | CU | CU | CU | CU | CU | CU | CU | CU | CU | CU |
| 1300 | CU | CU | CU | CU | CU | CU | CU | CU | CU | CU | CU | CU |
| 1400 | CU | CU | CU | CU | CU | CU | CU | CU | CU | CU | CU | CU |
| 1500 | CU | CU | CU | CU | CU | CU | CU | CU | CU | CU | CU | CU |

TABLE 8-continued

| PSI | SECONDS .10 | .5 | 1 | 1.5 | 2 | 2.5 | 3 | 3.5 | 4 | 4.5 | 5 | 5.5 |
|---|---|---|---|---|---|---|---|---|---|---|---|---|
| 1600 | CU | CU | CU | CU | CU | CU | CU | CU | CU | CU | CU | CU |
| 1700 | CU | CU | CU | CU | CU | CU | CU | CU | CU | CU | CU | CU |
| 1800 | CU | CU | CU | CU | CU | CU | CU | CU | CU | CU | CU | CU |
| 1900 | CU | CU | CU | CU | CU | CU | CU | CU | CU | CU | CU | CU |
| 2000 | CU | CU | CU | CU | CU | CU | CU | CU | CU | CU | CU | CU |
| 2100 | CU | CU | CU | CU | CU | CU | CU | CU | CU | CU | CU | CU |
| 2200 | CU | CU | CU | CU | CU | CU | CU | CU | CU | CU | CU | CU |
| 2300 | CU | CU | CU | CU | CU | CU | CU | CU | CU | CU | CU | CU |
| 2400 | CU | CU | CU | CU | CU | CU | CU | CU | CU | CU | CU | CU |
| 2500 | CU | NWR | NWR | NWR | NWR | NWR | NWR | NWR | NWR | NWR | NWR | NWR |
| 2600 | NWR | NWR | NWR | NWR | NWR | NWR | NWR | NWR | WR | WR | WR | WR |
| 2700 | WR | WR | WR | WR | WR | WR | WR | WR | WR | DO | DO | DO |
| 2800 | DO | DO | DO | DO | DO | DO | DO | DO | DO | DO | DO | DO |
| 2900 | DO | DO | DO | DO | DO | DO | DO | DO | DO | DO | DO | DO |
| 3000 | DO | DO | DO | DO | DO | DO | DO | DO | DO | DO | DO | DO |

As the results indicate, for pressures in the range 2,500 to 2,700 p.s.i., successful compaction occurred. However, for the 2,500 p.s.i. and 2,700 p.s.i. values, compaction was only successful for certain time ranges. Thus, for the 2,500 p.s.i. pressure, a time of at least one-half second was required to get successful compaction. At pressure ranges from 2,600 to 2,700 p.s.i., water was required for recovery. At 2,700 p.s.i., the pressure can only be applied for four seconds at the most, to avoid damage. At a pressure of 2,600 p.s.i., successful compaction occurred at all times in the chart.

For all examples, the woven sheet article was inserted into the mold or die by random placement in cavity 14. Tests showed that the manner in which the fabric is placed in the mold was immaterial.

It can be noted from the preceding examples that the non-blended synthetics compacted to NWR at lower pressures than the blended synthetics. In all of the examples, the lower part of the pressure range provided recovery without the use of water or air recovery, while the upper part of acceptable pressure range requires water for recovery. The average volume reduction accomplished by this method is 60%.

It will be appreciated that while examples have been given for certain selected materials, the pressures and stay times can be varied dependent upon the material of the article. In general, this will depend upon the actual composition of the material of the article, as well as the nature of the article, i.e. whether it is loosely or tightly woven, etc. A person skilled in this art can readily determine acceptable pressures for different articles. In particular for some materials it may prove acceptable to use pressures below 400 p.s.i., while still obtaining a satisfactory compacted article that can be returned to its original condition without the use of water or other liquid.

While the invention has been described by way of example, in relation to certain specific materials and articles, it will be appreciated that it is applicable to a wide variety of materials. For example, various blends of cotton, polyester, rayon, nylon, silk, wool, linen, etc., would be used. Thus, a variety of textiles could be compressed and packaged in accordance with the present invention. Such textiles include blankets, beach towels, and mattress covers.

Further, the invention is believed to be particularly applicable to the packaging of both disposable and reusable cotton baby diapers. Particularly for disposable diapers, the diapers are quite bulky, which results in excessive packaging, handling and transportation costs. If their volume could be reduced, the costs of handling, transportation, etc. could be reduced. Further, an end-user or purchaser could more readily handle a package of compressed diapers.

Similar advantages can be obtained for reusable, woven, cloth diapers. In this case, it may even prove advantageous for companies providing a diaper service to use the compression and packaging method of the present invention. This again would save on handling and transportation charges, while presenting the user with a more attractive package of diapers.

What we claim is:

1. A method of compressing a woven sheet article comprising 100% nylon, to produce a solid, stable, compacted article, the method comprising:

(a) placing the sheet article in a mold;

(b) subjecting the sheet article to an elevated pressure in the range 1,000 p.s.i. to 1,900 p.s.i. for a certain time, which pressure and time are selected so that the sheet article is compressed to form a stable, substantially rigid, compacted article, which retains substantially the shape of the mold after removal therefrom and which compacted article can be returned to its original uncompacted condition by manipulation thereof without the addition of any liquid; and (c) removing the compacted article from the mold.

2. A method as claimed in claim 1, wherein during step (b) the pressure is applied for at least 1 second, and the pressure is in the range 1,000 p.s.i. to 1,800 p.s.i.

3. A method of compressing a woven sheet article comprising 100% rayon, to produce a solid, stable, compacted article, the method comprising:

(a) placing the sheet article in a mold;

(b) subjecting the sheet article to an elevated pressure in the range 400 p.s.i. to 500 p.s.i. for a certain time, which pressure and time are selected so that the sheet article is compressed to form a stable, substantially rigid, compacted article, which retains substantially the shape of the mold after removal therefrom and which compacted article can be returned to its original uncompacted condition by manipulation thereof without the addition of any liquid; and (c) removing the compacted article from the mold.

4. A method as claimed in claim 3, wherein during step (b) the pressure is applied for at least 0.5 seconds.

5. A method of compressing a woven sheet article comprising a blend of polyester and rayon, to produce a solid, stable, compacted article, the method comprising:

(a) placing the sheet article in a mold;

(b) subjecting the sheet article to an elevated pressure in the range 300 p.s.i. to 1,000 p.s.i. for a certain time, which pressure and time are selected so that the sheet article is compressed to form a stable, substantially rigid, compacted article, which retains substantially the shape of the mold after removal therefrom and which compacted article can be returned to its original uncompacted condition by manipulation thereof without the addition of any liquid; and (c) removing the compacted article from the mold.

6. A method as claimed in claim 5, wherein the material of the woven sheet article comprises approximately 50% polyester and 50% rayon, and wherein during step (b) the pressure is applied for at least 3 seconds, and the pressure is in the range 300 p.s.i. to 900 p.s.i.

7. A method of compressing a woven sheet article comprising 100% polyester, to produce a solid, stable, compacted article, the method comprising:

(a) placing the sheet article in a mold;

(b) subjecting the sheet article to an elevated pressure in the range 300 p.s.i. to 2,600 p.s.i. for a certain time, which pressure and time are selected so that the sheet article is compressed to form a stable, substantially rigid, compacted article, which retains substantially the shape of the mold after removal therefrom and which compacted article can be returned to its original uncompacted condition by manipulation thereof without the addition of any liquid; and (c) removing the compacted article from the mold.

8. A method as claimed in claim 7, wherein the woven sheet article comprises fabric by piece, and wherein during step (b) the pressure applied is in the range 300 p.s.i. to 1,700 p.s.i.

9. A method as claimed in claim 8, wherein during step (b) the pressure is applied for at least 4.5 seconds, and the pressure is in the range 300 p.s.i to 1,600 p.s.i.

10. A method as claimed in claim 7, wherein the woven sheet article comprises anti-static wipes, and wherein during step (b) the pressure applied is in the range 300 p.s.i. to 2,600 p.s.i.

11. A method as claimed in claim 10, wherein during step (b) the pressure is applied for at least 4.5 seconds, and the pressure is in the range 300 p.s.i. to 2,500 p.s.i.

12. A method of compressing a woven sheet article comprising a blend of polyester, wool and polypropylene, to produce a solid, stable, compacted article, the method comprising:

(a) placing the sheet article in a mold;

(b) subjecting the sheet article to an elevated pressure in the range 500 p.s.i. to 2,500 p.s.i. for a certain time, which pressure and time are selected so that the sheet article is compressed to form a stable, substantially rigid, compacted article, which retains substantially the shape of the mold after removal therefrom and which compacted article can be returned to its original uncompacted condition by manipulation thereof without the addition of any liquid; and (c) removing the compacted article from the mold.

13. A method as claimed in claim 12, wherein the material of the woven sheet article comprises approximately 50% polyester, 30% wool and 20% polypropylene, and wherein during step (b) the pressure applied is in the range 500 p.s.i. to 2,500 p.s.i.

14. A method as claimed in claim 13, wherein during step (b) the pressure is applied for at least 0.1 second, and the pressure is in the range 500 p.s.i. to 2,400 p.s.i.

15. A method of compressing a woven sheet article comprising a blend of nylon and orlon acrylic, to produce a solid, stable, compacted article, the method comprising:

(a) placing the sheet article in a mold;

(b) subjecting the sheet article to an elevated pressure in the range 1,900 p.s.i. to 2,500 p.s.i. for a certain time, which pressure and time are selected so that the sheet article is compressed to form a stable, substantially rigid, compacted article, which retains substantially the shape of the mold after removal therefrom and which compacted article can be returned to its original uncompacted condition by manipulation thereof without the addition of any liquid; and (c) removing the compacted article from the mold.

16. A method as claimed in claim 15, wherein the material of the woven sheet article comprises approximately 25% nylon and 75% orlon acrylic, and wherein during step (b) the pressure is applied for at least 4.5 seconds, and the pressure is in the range 1,900 p.s.i. to 2,400 p.s.i.

17. A method of compressing a woven sheet article comprising a blend of bulk acrylic and nylon, to produce a solid, stable, compacted article, the method comprising:

(a) placing the sheet article in a mold;

(b) subjecting the sheet article to an elevated pressure in the range 2,500 p.s.i. to 2,600 p.s.i. for a certain time, which pressure and time are selected so that the sheet article is compressed to form a stable, substantially rigid, compacted article, which retains substantially the shape of the mold after removal therefrom and which compacted article can be returned to its original uncompacted condition by manipulation thereof without the addition of any liquid; and (c) removing the compacted article from the mold.

18. A method as claimed in claim 17, wherein the material of the woven sheet article comprises approximately 85% bulk acrylic and 15% nylon and, wherein during step (b) the pressure is applied for at least 0.5 seconds, and the pressure is in the range 2,500 p.s.i. to 2,600 p.s.i.

* * * * *